US009493270B2

(12) United States Patent
Dubois et al.

(10) Patent No.: US 9,493,270 B2
(45) Date of Patent: Nov. 15, 2016

(54) LARGE LOAD CARRIER

(71) Applicant: Georg Utz Holding AG, Bremgarten (CH)

(72) Inventors: Jean-Marc Dubois, Bremgarten (CH); Christian Mathews, Linkenheim-Hochstetten (DE); Juergen Straub, Albershausen (DE)

(73) Assignee: George Utz Holding AG, Bremgarten (CH)

( * ) Notice: Subject to any disclaimer, the term of this patent is extended or adjusted under 35 U.S.C. 154(b) by 0 days.

(21) Appl. No.: 14/686,901

(22) Filed: Apr. 15, 2015

(65) Prior Publication Data

US 2015/0217902 A1 Aug. 6, 2015

Related U.S. Application Data

(63) Continuation of application No. 11/542,095, filed on Oct. 3, 2006, now abandoned.

(30) Foreign Application Priority Data

Oct. 5, 2005 (DE) ..... 10 2005 047 816

(51) Int. Cl.

| | |
|---|---|
| ***B65D 19/16*** | (2006.01) |
| ***B65D 21/08*** | (2006.01) |
| ***B65D 19/12*** | (2006.01) |
| ***B65D 19/06*** | (2006.01) |

(Continued)

(52) U.S. Cl.

CPC ..... *B65D 21/086* (2013.01); *B65D 19/06* (2013.01); *B65D 19/12* (2013.01); *B65D 19/385* (2013.01); *B65D 19/40* (2013.01); *B65D 2519/009* (2013.01); *B65D 2519/00024* (2013.01); *B65D 2519/00059* (2013.01); *B65D 2519/0082* (2013.01); *B65D 2519/00164* (2013.01); *B65D 2519/00199* (2013.01); *B65D 2519/00338* (2013.01); *B65D 2519/00422* (2013.01); *B65D 2519/00522* (2013.01); *B65D 2519/00532* (2013.01); *B65D 2519/00572* (2013.01); *B65D 2519/00611* (2013.01); *B65D 2519/00656* (2013.01); *B65D 2519/00731* (2013.01); *B65D 2519/00805* (2013.01); *B65D 2519/00875* (2013.01)

(58) Field of Classification Search

CPC .... B65D 21/086; B65D 19/40; B65D 19/16; B65D 2519/009; B65D 90/0033; B65D 90/0006; B65D 90/0053; B65D 88/522; B65D 88/546; B65D 88/56; B65D 25/103; B65D 25/102; B65D 25/101; B65D 25/10; B65D 25/02

USPC ..... 220/1.5, 832

See application file for complete search history.

(56) References Cited

U.S. PATENT DOCUMENTS

| | | | |
|---|---|---|---|
| 2,155,872 | A | 4/1939 | Reifer et al. |
| 2,885,091 | A | 5/1959 | Van Pelt |

(Continued)

*Primary Examiner* — Stephen Castellano
(74) *Attorney, Agent, or Firm* — Collard & Roe, P.C.

(57) ABSTRACT

A large load carrier having a rectangular, pallet-like floor part and lengthwise and crosswise side walls that rise from the floor part. Either the lengthwise side walls or the crosswise side walls have contact points for several frames disposed one above the other, in the region against the other side walls, as carriers for the inserts (layers) that carry the goods to be transported. The side walls can be folded on top of one another towards the inside, and the frames are releasably mounted in the contact points.

4 Claims, 11 Drawing Sheets

(51) Int. Cl.
*B65D 19/38* (2006.01)
*B65D 19/40* (2006.01)

(56) References Cited

U.S. PATENT DOCUMENTS

| | | | |
|---|---|---|---|
| 2,924,222 | A | 2/1960 | Myers |
| 3,346,126 | A | 10/1967 | Bloom et al. |
| 3,530,997 | A | 9/1970 | Djorup |
| 3,559,591 | A | 2/1971 | Breen et al. |
| 3,590,746 | A | 7/1971 | Gibson |
| 3,907,148 | A | 9/1975 | Meller et al. |
| 3,964,608 | A | 6/1976 | Rowley |
| 4,010,848 | A | 3/1977 | Pater et al. |
| 4,074,634 | A | 2/1978 | Snow et al. |
| 4,099,640 | A | 7/1978 | Nessfield et al. |
| 4,324,076 | A | 4/1982 | Honickman |
| 5,038,962 | A | 8/1991 | Ruebesam |
| 5,076,454 | A | 12/1991 | Garton et al. |
| 5,145,073 | A | 9/1992 | Kitagawa et al. |
| 5,161,709 | A | 11/1992 | Oestreich, Jr. |
| 5,314,276 | A | 5/1994 | Barone |
| 5,388,939 | A | 2/1995 | Barone |
| 5,593,058 | A | 1/1997 | Spencer et al. |
| 5,671,850 | A | 9/1997 | Basala |
| 6,510,955 | B2 | 1/2003 | Pellegrino |
| 2007/0075077 | A1 | 4/2007 | Dubois et al. |

Detail A

SECTION A-A

LARGE LOAD CARRIER

CROSS-REFERENCE TO RELATED APPLICATIONS

This application is a continuation of U.S. patent application Ser. No. 11/542,095, filed on Oct. 3, 2006, now abandoned, which claims priority under 35 U.S.C. 119 of German Patent Application No. 10 2005 047 816.6, filed on Oct. 5, 2005. The disclosures of both of these applications is herein incorporated by reference.

BACKGROUND OF THE INVENTION

1. Field of the Invention

The invention relates to a large load carrier having a rectangular, pallet-like floor part and lengthwise and crosswise side walls that rise from the floor part. The lengthwise side walls or the crosswise side walls have contact points for several frames disposed one above the other, in an area against the other side walls, as carriers for the inserts (layers) that carry the goods to be transported.

2. The Prior Art

Up to the present, steel large load carriers have been used, which are either welded completely or have four corner profiles and three crosswise profiles that are screwed onto a base frame. Movable frames onto which work piece accommodations (layers) can be attached can be pushed through a bore in the corner profile on the crosswise side wall, for example, and then be secured by means of a screw or a plug-in fixation element. Gas pressure springs are used laterally on the frames, in order to hold the brackets in the flipped-up state at the top. The work pieces stored on the individual layers are worked off from the topmost layer down, in automobile production, for example. This layer is then flipped up, together with the frame, so that the layer that lies underneath becomes accessible.

A disadvantage of these steel large load carriers is that they always have the same outside volume, during transport back and forth and during storage.

SUMMARY OF THE INVENTION

It is therefore an object of the invention to provide a large load carrier where after removal of the work pieces that have been delivered, the container can be collapsed, in order to save both storage space and return transport costs.

This object is accomplished according to the invention by a carrier having side walls that can be folded on top of one another towards the inside, and having frames releasably mounted in the contact points.

The advantages that result from this become clear in the following example. As an example, two large containers according to the invention are delivered, each of them having three layers with frames and work piece carriers.

Each container has contact points for six frames. After both large containers have been emptied, the frames with the work piece carriers are removed from one of the large containers, and inserted into the other large load carrier, so that the large load carrier now has such frames on all of the contact points, while the first large load carrier is completely empty. This can then be collapsed in a known manner, so that the lengthwise side walls are first folded on top of one another, and then the two crosswise side walls.

In the case of such collapsible large load carriers, bores are integrated into the crosswise side walls in a fixed interval pattern, for example. The bores accommodate the rotation axles of the frames as well as the attachment of the gas springs on the container side.

Since the locks for the lengthwise and crosswise side walls are situated in the upper edge region in the collapsible large load carriers, there is no room there for such bores, and that is also true for the lower container region, i.e., the hinge region.

Therefore, if contact points for the frames mentioned above are also required in these regions, there can be provided strips for the contact points of the frames, which strips are vertically disposed and take up the entire height of the crosswise side walls. The strips can be attached on the inside of the crosswise side walls, through the bores in the crosswise side walls. However, depending on the embodiment, the contact points can also be provided in the lengthwise side walls.

If such a container is supposed to be collapsed after having been emptied, the strips attached to the crosswise side walls are removed, and laid flat into the floor of the container. Afterwards, the container can be collapsed.

The frames, as said above, are mounted to pivot in the contact points, and are held in their pivoted position by means of gas pressure springs. Such contact points can be provided by the crosswise side wall bores themselves, as stated above.

The contact points can be bores in the strips, disposed vertically one above the other. The points of rotation of the frames can be formed by tabs.

As an alternative, bolts can be attached in the strips, which bolts form the pivot axles of the frame. For this purpose, the lengthwise strut of the frame on the contact point side is extended beyond the crosswise struts. Since the frame is formed from rectangular profiles, a part is cut out of the edge region of the frame extension, so that an accommodation opening for the bolt is formed and thereby it is assured that the frame will not slip out of this accommodation opening when it is pivoted up.

A sleeve or the bolt can be inserted into each of the strip bores, and this sleeve or this bolt, respectively, together with a ball head, is disposed on a flat crosspiece that fits into a complementary recess on the back of the strip. The ball head projects past the strip on the side. This ball head serves as the attachment of the gas pressure spring on the container side.

Strips are screwed onto the crosswise side walls, specifically through some bores that are present in the crosswise side walls. The strips can be set onto the heads of screws inserted into the bores of the crosswise side walls, similar to what is usual for picture frame hangers.

Oblong holes are provided in the strips, in the upper region of which a plug element is provided. The plug element can be set onto the screw head attached in the crosswise side wall.

With this solution, it is possible to pull off the strips easily after a container has been emptied, and to lay them flat onto the floor of the container, before the container is collapsed.

The side of the strip that faces the frame has slots that run from the front at a slant to the back, to accommodate the frame pivot axles. In this manner, it is possible simply to push the frames with the work piece accommodations into the container.

With this alternative, gas pressure springs are not necessarily required, since after a work piece accommodation has been emptied, it can be pulled out of the container, along with the frame.

In order for the frames to maintain their parallel distance from one another, spacer elements are provided on the frame, disposed at a right angle on the plane that passes through the frame. These are disposed in the front, free frame region, in such a manner that the lower frame forms the support for the frame disposed above it, with its spacer elements.

Alternatively, strips can be disposed on the lengthwise side wall, which is removed from the contact points. Supports for the free front part of the frames, which supports can be folded out and in, are provided at defined intervals on the strips.

The supports are held by means of the magnets in their folded-in state. In the folded-down state, they therefore also serve as spacers. After the frame is pivoted, these supports are folded up against the strip.

Finally, a bracket for the uppermost frame is provided on the lengthwise side wall that is removed from the contact points. The shank of the bracket, facing the container, rests on the front frame part. Thus, if the spacer elements are provided, all of the layers are secured by the bracket to prevent vertical movement.

The bracket is attached to a part of the lengthwise side wall that can be folded out. These folding parts serve to make the contents of the container more easily accessible. Such regions that can be folded out can be present both in the lengthwise side walls and in the crosswise side walls.

As soon as such a part, on which the bracket is attached, has been folded down, the uppermost frame is automatically unlocked. It can now either be taken out of the container, according to one alternative, or it can be pivoted away upward after the work pieces have been removed.

Existing large load carriers can be retrofitted with the strips and brackets in a simple manner.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 9:
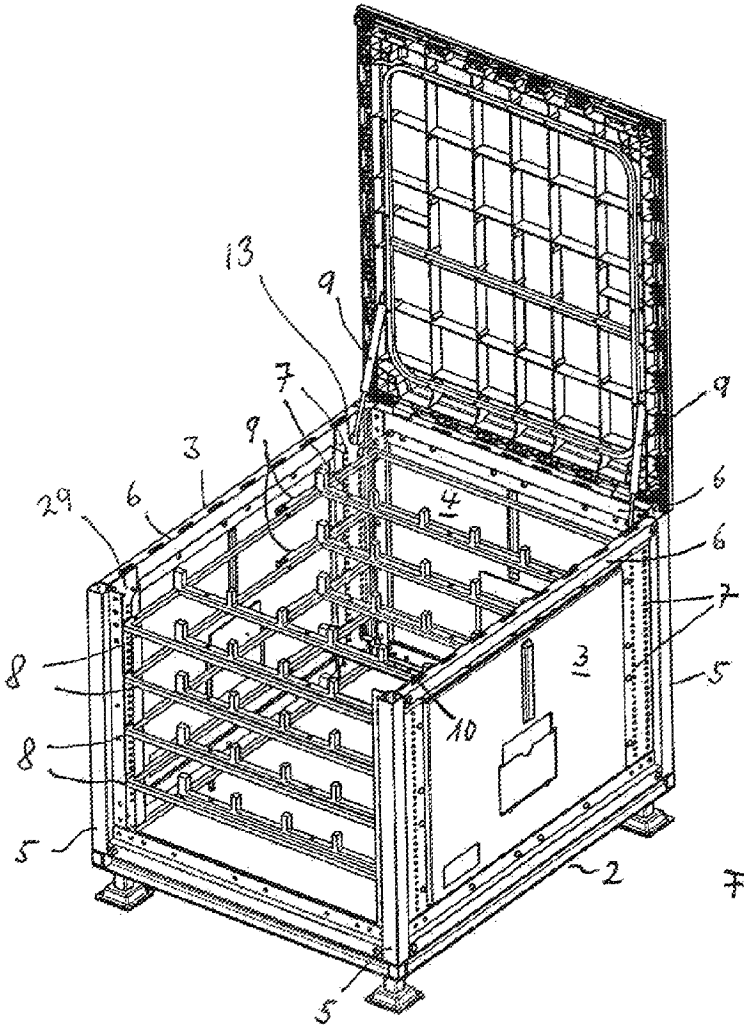
FIG. 9 shows a large load carrier according to the state of the art.

In FIG. 9, a large load carrier is shown and indicated in general with the reference symbol 1. It consists of a pallet-shaped floor part 2, from which two crosswise side walls 3 and two lengthwise side walls 4 rise. In this case, floor part 2 is a base frame onto which four corner profiles 5 and three crosswise profiles 6 are screwed or welded.

In the rear region of the container, contact points 7 are provided in the crosswise side walls 3, in which four frames 8, in the present case, are mounted so as to pivot. In this case, contact points 7 are bores present in the crosswise side walls 3, and are secured by a screw or a plug-in fixation element. Pneumatic springs 9 are disposed on frame 8, so that they can hold the frame up in the flipped-up state.

Frames 8 each carry a work piece accommodation (layer) 10. The work piece accommodations are worked off from top to bottom in production. Each worked-off layer 10 is then flipped up, so that the layer that lies underneath becomes accessible.

Once the container has been emptied completely, it is transported back, and the outer volume is unchanged.

Figure 1:
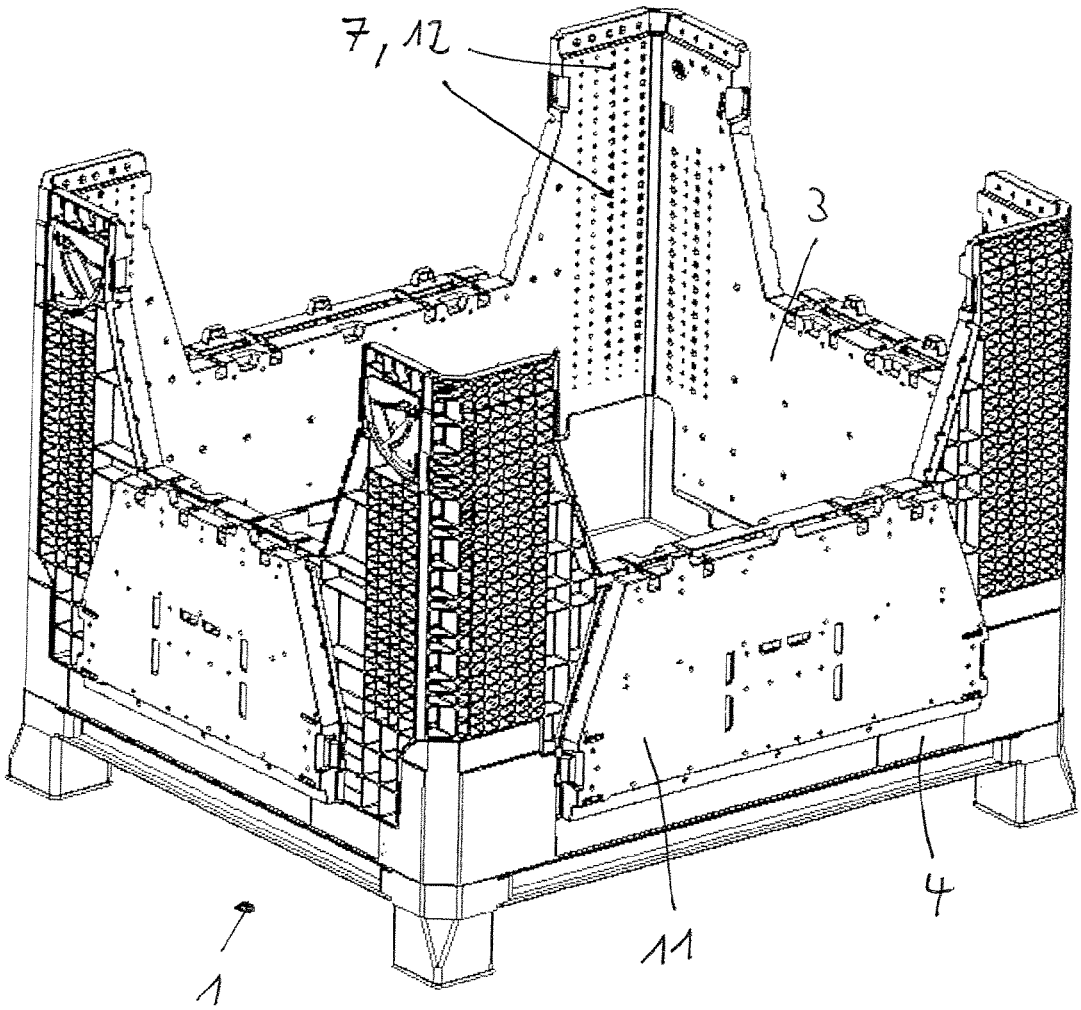
FIG. 1 shows a collapsible large load container according to one embodiment of the invention.

FIG. 1 shows the fundamental concept of a large load carrier according to the invention. In the case of this large load carrier, partial regions 11 in the lengthwise and crosswise side walls can be folded out, in order to optimize the accessibility of the container.

Both crosswise side walls 3 and lengthwise side walls 4 can be folded against one another and on top of one another, if container 1 has been completely emptied. As is evident from FIG. 1, bores 12 are integrated into the corner regions of side walls 3 and side walls 4, respectively, in a certain pattern.

Figure 2:
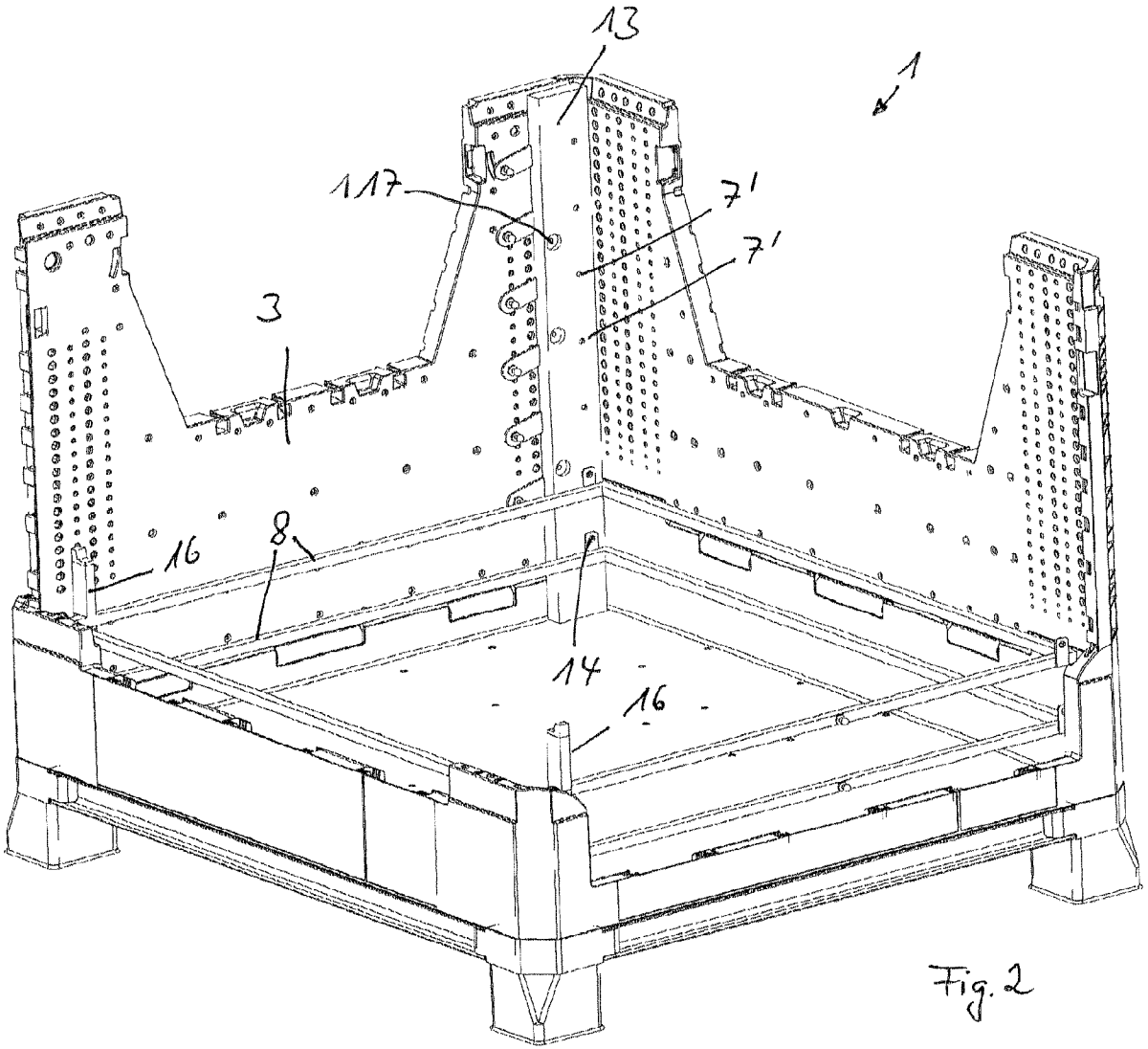
FIG. 2 shows a large load carrier according to FIG. 1, with a lengthwise side wall and crosswise side wall left out.

A container 1 according to FIG. 1 is also shown in FIG. 2. Here, one lengthwise side wall and one crosswise side wall have been left out for reasons of clarity. In crosswise side walls 3, strips 13 are attached in the region against lengthwise side wall 4, which take up the entire height of the container walls, and have contact points 7 on which a frame 8 is attached so as to pivot by means of tabs 14, in each instance, as shown in the lower region of container 1.

Spacers 16 that project vertically upward are disposed in the front, free region 15 of frame 8. Lower frame 8, in each instance, therefore supports the frame situated above it.

Figure 3A:
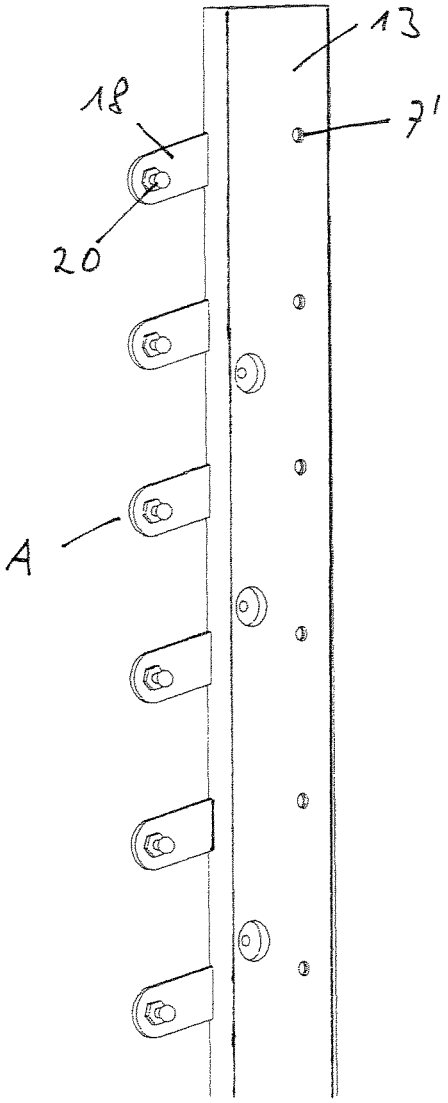
FIGS. 3*a* and *b* show strip elements for use with the container according to the invention.
Figure 3B:
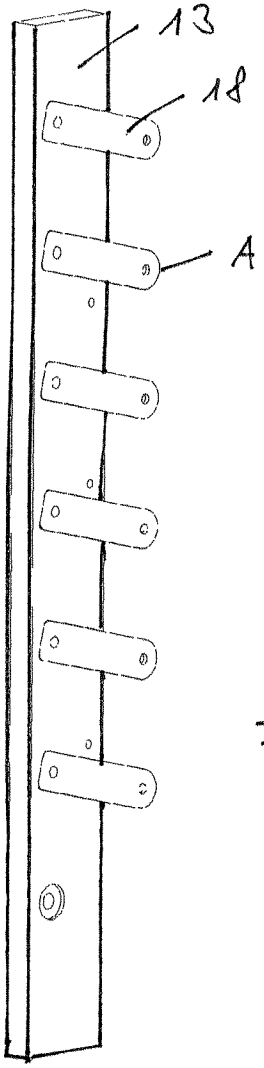

In the present example, strips 13 are attached in the bores of crosswise side walls 3 by three screws 117. The configuration of strips 13 is more clearly evident from FIGS. 3*a* and 3*b*. FIG. 3*a* shows the strip from its side that faces into the container, while FIG. 3*b* represents the back of the strip.

Figure 4:
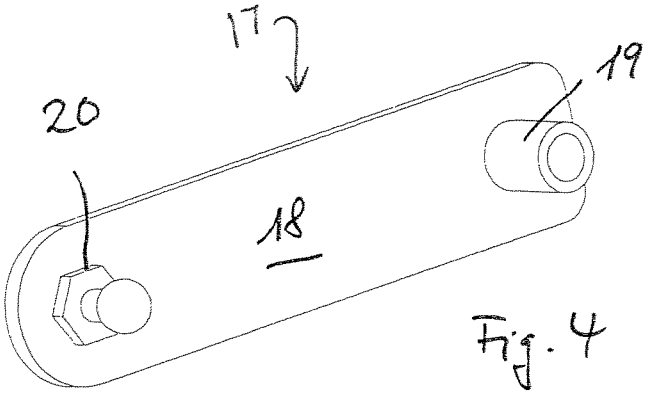
FIG. 4 shows a detail A from FIG. 3.

Elements 17 as shown in Detail A in FIG. 4 are attached to strips 13 at specific intervals. These elements 17 consist of a crosspiece 18 on the one side of which a sleeve or a journal 19 is disposed, and on the opposite side a ball-head screw 20. Crosspiece 18 fits into a corresponding recess in the back of strip 13, specifically in such a manner that ball head 20 projects past strip 13 on the side, and is disposed somewhat lower than journal 19.

Ball head 20 serves as a container-side attachment point for pneumatic spring 9 shown in FIG. 9. Journal or sleeve 19, serve as contact points for the pivoting attachment of frame 8.

The component shown in FIG. 4 is a standard part that can be used independent of the container series. Only strips 13 must be adapted accordingly.

Figure 5A:
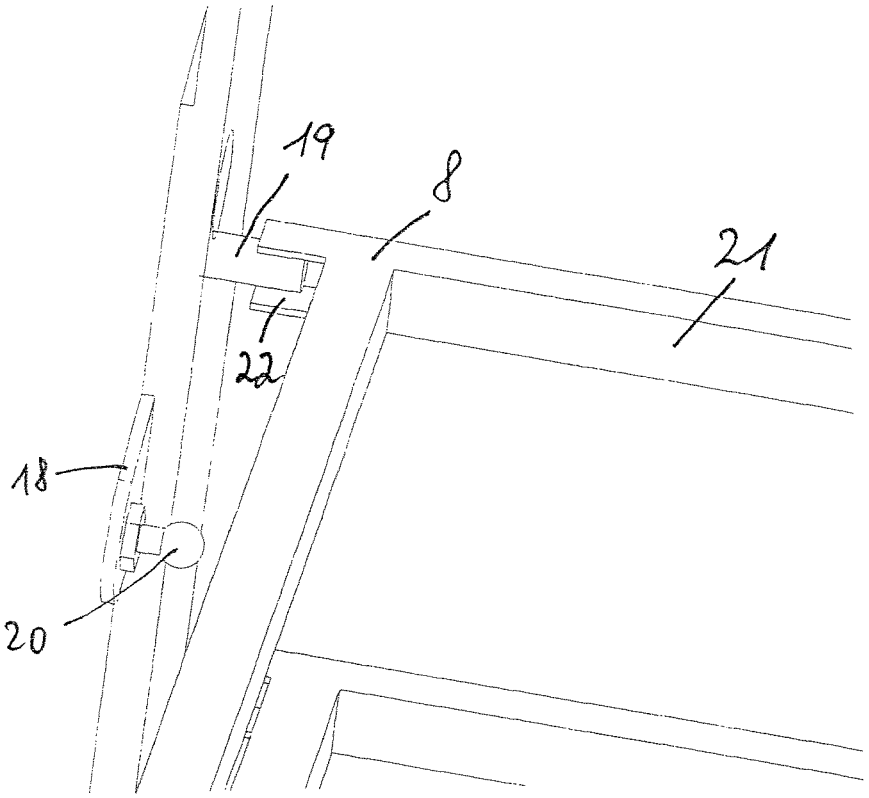
FIG. 5*a* shows, in detail, a strip element with part of a frame.

Tab 14 of the frame is attached with a screw here, as shown at the top. However, an alternative is shown in FIG. 5*a*, in which journal 19 projects beyond the front side of strip 13 and serves as a shaft for frame 8. In this connection, frame 8 is configured in such a manner that rear part 21 of the frame projects laterally and has an opening 22, in which journal 19 can be accommodated.

However, it is a disadvantage in this embodiment that if the frame is pivoted upward, the journal can exit from opening 22.

Figure 5B:
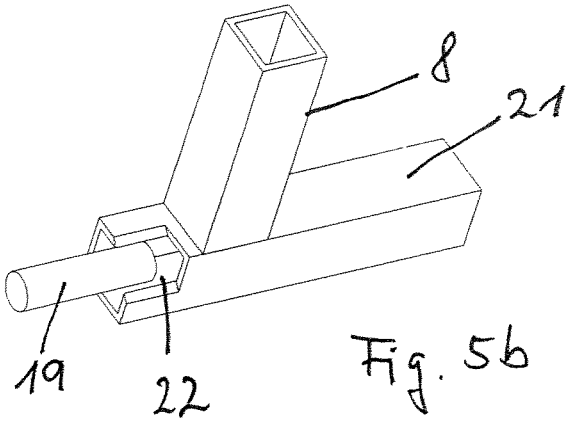
FIG. 5*b* shows an alternative frame configuration.

In order to avoid this, a different solution is shown in FIG. 5*b*. Here, opening 22 is introduced into the edge region of the projecting part of frame part 21. If the frame is pivoted upward, the bolt still rests against a contact point. Slipping out is therefore precluded.

As shown further above, strips 13 can be screwed onto the inside of the side crosswise wall, as shown in FIG. 2.

Figure 6A:
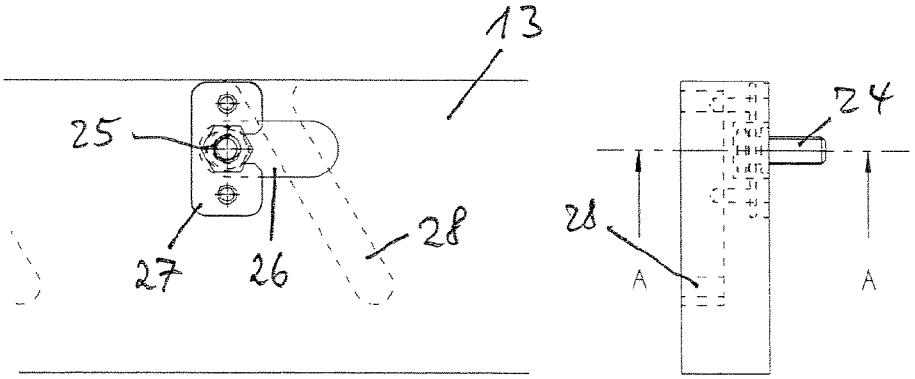
FIG. 6*a* shows an alternative type of attachment of the strips from FIG. 3.
Figure 6B:
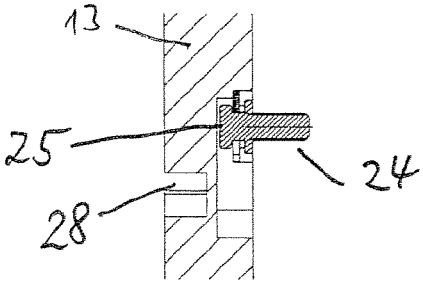
FIG. 6*b* shows a perspective representation of the type of attachment shown in FIG. 6*a;*
Figure 6B:
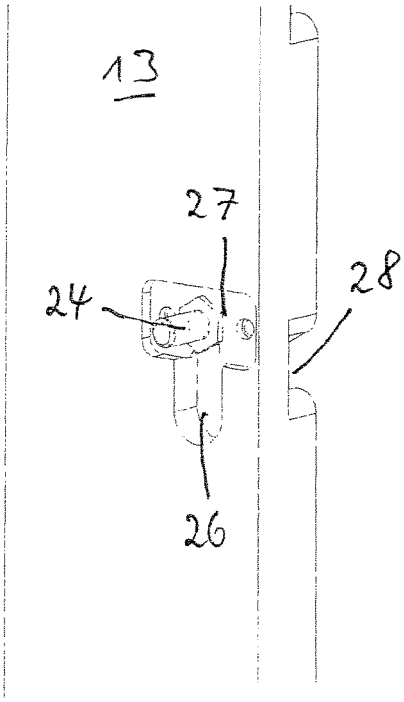

An alternative embodiment is shown in FIGS. 6*a* and 6*b*.

As the lower figure in FIG. 6*a* shows, a screw 24 is screwed into crosswise side wall 3, the head of which screw serves as a plug-on element for strip 13.

For this purpose, oblong holes 26 are made in strip 13 at regular intervals, one above the other, at the upper end of which a plug element 27 is attached. Plug element 27 acts together with screw head 25 during the plug-on process. The advantage of this embodiment can be seen in that after a large load carrier 1 has been emptied, the strips can be rapidly removed, laid into the floor region of the container, and then the container can be collapsed without problems.

As is evident from the drawings of FIG. 6*a*, grooves 28 that lead obliquely downward and to the rear are worked into the side of strip 13 that faces the container interior, and serve as alternative accommodations for frames 8.

With this solution, the frames, with the layers, can be easily pushed into or pulled out of container 1, without a pivoting movement and the related pneumatic spring being required.

Figure 7A:
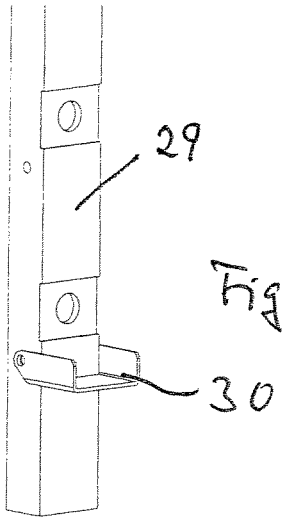
FIGS. 7*a* and *b* show strips with support elements in the folded-out and folded-in state.
Figure 7B:
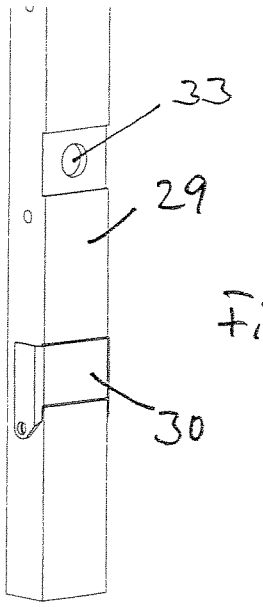

A strip 29 is shown in FIGS. 7*a* and 7*b*, which can be disposed individually or in pairs on the crosswise or lengthwise side wall 4 that lies removed from the contact points of frame 8. Support elements 30 are disposed on strips 29, so as to tilt. In FIG. 7*a*, element 30 is folded down, and the front, free end of frame 8 can be supported on this element.

Figure 8:
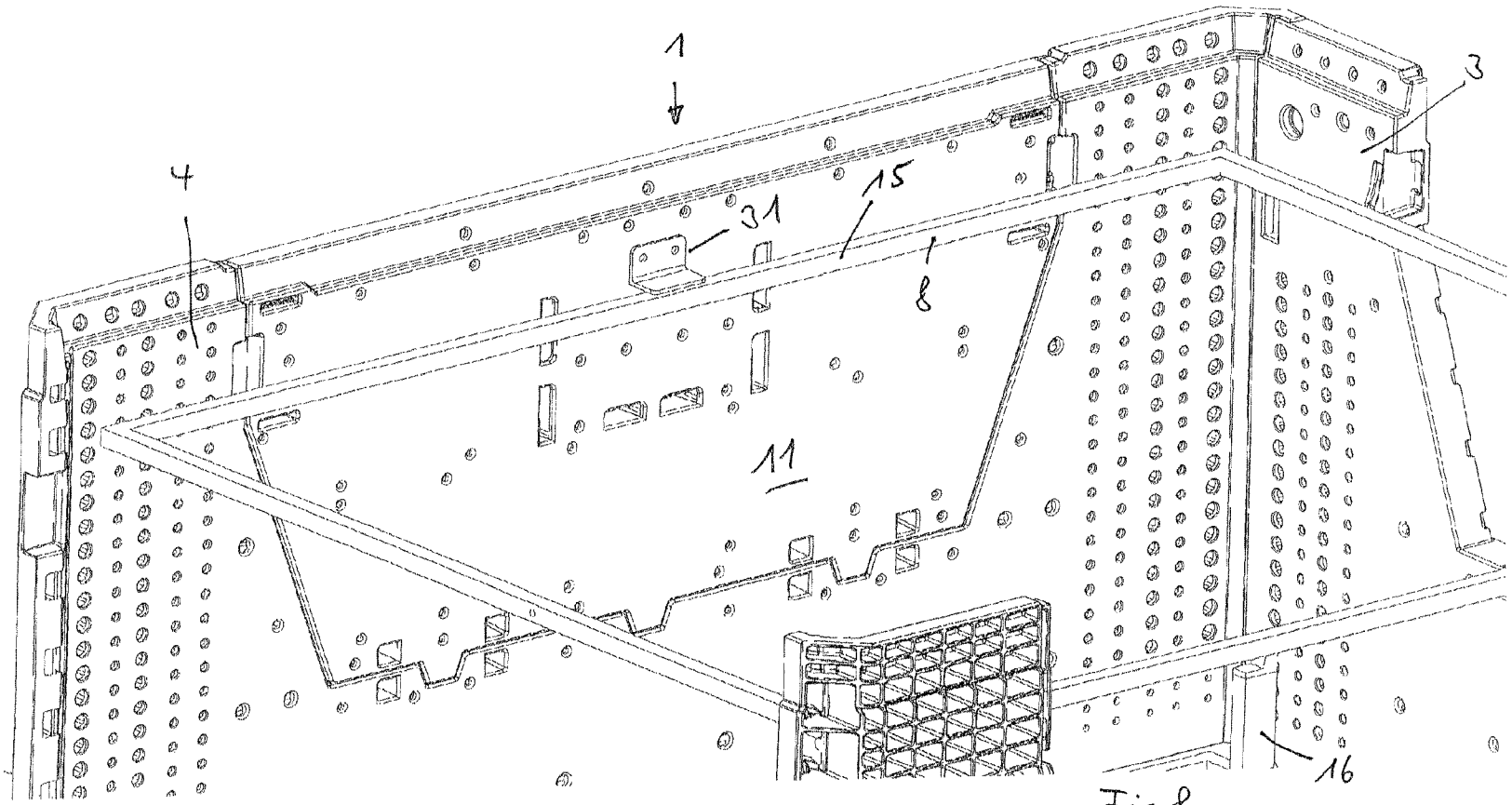
FIG. 8 shows a front lengthwise side wall of a large load carrier with holder bracket for the uppermost frame.

If frame 8 has been removed or pivoted away to the top, element 30 is tilted up against the strip and held in place there by a magnet that is inserted into accommodation 33. Finally, lengthwise side wall 4 mentioned in FIG. 7 is shown in FIG. 8.

However, here the additional strips 29 are no longer present. Here, a bracket 31 is shown in the upper region of lengthwise side wall 4, which bracket is attached to region 11 of this lengthwise side wall that can be folded out. The shank of bracket 31 that faces inward sits on the top of uppermost frame 8. The frame is therefore secured during transport. If region 11 is folded down and outward, this securing mechanism for the frame is cancelled out and it can be pivoted away upward.

All of frames 8 disposed one above the other stand in connection by way of spacer elements 16, as indicated in the figure, bottom right, and all of the frames and the layers supported on them are thereby secured against vertical movements during transport, by means of bracket 31.

Accordingly, while only a few embodiments of the present invention have been shown and described, it is obvious that many changes and modifications may be made thereunto without departing from the spirit and scope of the invention.

What is claimed is:

1. A load carrier, comprising:

a rectangular, pallet-like floor part;

lengthwise and crosswise side walls that rise from said floor part;

strips releasably attached on an inside of two opposite side walls, said strips being vertically disposed and extending the entire height of the side walls;

several frames disposed one above the other and pivotably mounted at contact points at the strips, said frames acting as carriers for inserts that carry goods to be transported, and pneumatic springs mounted for supporting the frames, wherein each spring is mounted at one end on a respective one of the frames and the other end on one of the strips;

wherein the pneumatic springs are mounted to the strips via flat crosspieces that fit into complementary recesses on the backs of the strips, each crosspiece having a ball head that projects past the strip on a side of the strip and pivotably connects one of the pneumatic springs to the strip, and wherein the side walls can be folded on top of one another towards an inside of the carrier.

2. The load carrier according to claim 1, wherein the strips are attached on an inside of the side walls.

3. The load carrier according to claim 1, further comprising a journal connected to each crosspiece and extending through the strip, each journal forming the contact point for pivotably mounting one of the frame, on the strip.

4. The load carrier according to claim 1, wherein each frame has a projecting portion with an opening for receiving one of the journals.

* * * * *

UNITED STATES PATENT AND TRADEMARK OFFICE

CERTIFICATE OF CORRECTION

PATENT NO. : 9,493,270 B2
APPLICATION NO. : 14/686901
DATED : November 15, 2016
INVENTOR(S) : Dubois et al.

It is certified that error appears in the above-identified patent and that said Letters Patent is hereby corrected as shown below:

On the Title Page

Column 1, item [73], the name of the Assignee correctly should read:

--Georg Utz Holding AG--.

Signed and Sealed this
Twenty-seventh Day of June, 2017

Joseph Matal

Joseph Matal
*Performing the Functions and Duties of the*
*Under Secretary of Commerce for Intellectual Property and*
*Director of the United States Patent and Trademark Office*